US009976569B2

(12) United States Patent
Janssens

(10) Patent No.: US 9,976,569 B2
(45) Date of Patent: May 22, 2018

(54) METHOD FOR RECOVERING ENERGY

(75) Inventor: Stijn Jozef Rita Johanna Janssens, Denderleeuw (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 1514 days.

(21) Appl. No.: 13/575,143

(22) PCT Filed: Dec. 27, 2010

(86) PCT No.: PCT/BE2010/000087
§ 371 (c)(1),
(2), (4) Date: Jul. 25, 2012

(87) PCT Pub. No.: WO2011/088527
PCT Pub. Date: Jul. 28, 2011

(65) Prior Publication Data

US 2012/0291434 A1 Nov. 22, 2012

(30) Foreign Application Priority Data

Jan. 25, 2010 (BE) ..... 2010/0038

(51) Int. Cl.
*F25B 27/02* (2006.01)
*F04D 29/58* (2006.01)
(Continued)

(52) U.S. Cl.
CPC ..... *F04D 29/5833* (2013.01); *F04B 39/06* (2013.01); *F04C 29/04* (2013.01); *F28D 21/0001* (2013.01)

(58) Field of Classification Search
CPC ..... F28D 21/0001; F04B 39/06; F01K 7/18; F02C 6/18; F02C 7/143; F04D 29/5826;
(Continued)

(56) References Cited

U.S. PATENT DOCUMENTS 4,279,574 A * 7/1981 Kunderman ..... F28D 15/00 165/295
4,342,201 A * 8/1982 Ishii ..... B01J 19/0013 62/238.4
(Continued)

FOREIGN PATENT DOCUMENTS

EP 0015535 A1 9/1980
EP 1591644 A1 11/2005
(Continued)

OTHER PUBLICATIONS

International Search Report issued in International Application No. PCT/BE2010/000087, dated Nov. 28, 2011.

*Primary Examiner* — Mark Laurenzi
*Assistant Examiner* — Anthony Ayala Delgado
(74) *Attorney, Agent, or Firm* — Bacon & Thomas PLLC

(57) ABSTRACT

Method for recovering energy when compressing a gas using a compressor system with two or more compression stages, with each stage having a compressor element. Downstream from at least two compressor elements there is a heat exchanger having a primary and a secondary part. The coolant is guided successively in series through the secondary part of at least two heat exchangers, and the guiding sequence is chosen such that the temperature at the inlet of the primary part of at least one subsequent heat exchanger is higher than or equal to the temperature at the inlet of the primary part of a preceding heat exchanger, relative to the direction of flow of the coolant. At least one heat exchanger is provided with a tertiary part for a coolant.

21 Claims, 3 Drawing Sheets

(51) Int. Cl.
*F04B 39/06* (2006.01)
*F04C 29/04* (2006.01)
*F28D 21/00* (2006.01)

(58) Field of Classification Search
CPC .... F04D 29/5833; F04D 25/16; F04D 29/584; F17C 2227/0157; F24D 11/005; F28F 27/02
USPC ..... 417/243, 313; 60/648
See application file for complete search history.

(56) References Cited

U.S. PATENT DOCUMENTS

| | | | | |
|---|---|---|---|---|
| 4,362,462 | A | 12/1982 | Blotenberg | |
| 4,936,109 | A | 6/1990 | Longardner | |
| 5,394,709 | A | 3/1995 | Lorentzen | |
| 6,981,850 | B1 * | 1/2006 | Maltbie | F22B 1/18 417/201 |
| 2005/0235625 | A1 | 10/2005 | Gericke et al. | |

FOREIGN PATENT DOCUMENTS

| | | | |
|---|---|---|---|
| GB | 105748 | A | 7/1917 |
| GB | 1025538 | A | 4/1966 |
| JP | 56-033489 | | 3/1981 |
| JP | 03279683 | A * | 12/1991 |

* cited by examiner

METHOD FOR RECOVERING ENERGY

BACKGROUND OF THE INVENTION

A. Field of the Invention

The present invention relates to a method for recovering energy.

B. Related Art

More specifically the invention relates to a method for recovering energy when gas is compressed by a compressor with two or more compression stages, with each stage realised by a compressor element, and in each case downstream from at least two aforementioned compressor elements there is a heat exchanger with a primary and a secondary part, more specifically a primary part through which the compressed gas from a compression stage upstream from the heat exchanger is guided, and a secondary part through which coolant is guided to recover part of the compression heat from the compressed gas.

It is known that the temperature of the gas at the inlet of a compression stage has an important effect on the energy consumption of the compressor.

It is thus desirable to cool the gas between successive stages.

Traditionally the gas is cooled between two successive stages by driving the gas through the primary part of a heat exchanger, whereby a coolant flows through the secondary part, generally water.

The total flow of the coolant supplied is thereby divided and distributed among the number of heat exchangers used. In other words the coolant is guided in parallel through the secondary parts of the heat exchangers.

The foregoing implies that the coolant enters the different heat exchangers at the same temperature.

When flowing through the heat exchangers the coolant heats up. When leaving the heat exchangers, the heated coolant is collected again. In normal design conditions, this heating is quite limited in order to efficiently cool with a limited cooling area.

However, if the stored heat is to be usefully deployed, it is desirable for this coolant heating to be greater, which implies that the coolant flow has to be throttled.

A disadvantage of this throttling is that the speed of the coolant flowing through the heat exchangers is greatly reduced, such that calcification can occur in the different heat exchangers.

Another disadvantage is that the limited speed of the coolant in the different heat exchangers goes against optimum heat transfer in the aforementioned heat exchangers.

SUMMARY OF THE INVENTION

The purpose of the present invention is to provide a solution to one or more of the aforementioned disadvantages and/or other disadvantages by providing a method for recovering energy when compressing a gas by a compressor with two or more compression stages, with each stage realised by a compressor element, whereby in each case downstream from at least two aforementioned compressor elements there is a heat exchanger with a primary and secondary part, more specifically a primary part through which the compressed gas from a compression stage upstream from the heat exchanger concerned is guided and a secondary part through which a coolant is guided to recover part of the compression heat from the compressed gas, whereby the coolant is guided successively in series through the secondary part of at least two heat exchangers, whereby the sequence in which the coolant is guided through the heat exchangers is chosen such that the temperature at the inlet of the primary part of at least one subsequent heat exchanger is higher than or equal to the temperature at the inlet of the primary part of a preceding heat exchanger, as seen in the direction of flow of the coolant, and whereby at least one heat exchanger is provided with a tertiary part for a coolant.

An advantage is that the speed of the coolant supplied can be better maintained by sending the coolant in series through the heat exchangers and not, as is known, divided among the different heat exchangers.

An advantage linked to this is that, as a result of the higher speed of the coolant in the different heat exchangers, the risk of calcification is substantially reduced.

Another advantage is that the higher flow rate of the coolant in the heat exchangers enables a better heat transfer between the compressed gas on the one hand and the coolant on the other.

By sending the coolant through the different heat exchangers according to the aforementioned sequence, the coolant has a higher temperature after it has gone through the heat exchangers compared to the existing methods for recovering energy.

In this way more energy can be recovered compared to the existing methods for recovering energy.

According to another preferred characteristic of the invention, the coolant is guided sequentially through all heat exchangers of the compressor.

Because the coolant is sent through all heat exchangers, a maximum of energy can be recovered.

Another preferred characteristic of the invention consists of the speed of one or more compressor elements being regulated according to an imposed criterion.

The operating parameters are preferably set such that each compressor element of the compressor achieves the highest possible efficiency. This is not easy as the different compressor elements are connected in series. Indeed, if a single compressor element operates in conditions that are not optimum or even detrimental to the efficiency of the aforementioned compressor element, then this has an impact on all subsequent compressor elements of the compressor.

It is important that successive compressor elements are attuned to one another so that the compressor as a whole can achieve maximum efficiency.

For a compressor with controllable relative speeds of the compression stages (for example a directly driven multistage compressor), this attuning of the compressor elements to one another can be done, in a method according to the invention, by responding to the sequence in which the coolant is guided through the different heat exchangers and the relative speed difference of the rotational speeds of the successive compressor elements.

The rotational speed of one or more compressor elements is thereby controlled according to an imposed criterion. More specifically, the rotational speed of one or more compressor elements is preferably adjusted such that the different compressor elements are attuned to one another in an optimum way, so that the compressor as a whole achieves the highest possible efficiency.

According to a particular aspect of the invention, the rotational speeds of the compression stages are controlled such that the change of each compressor stage-operating region as a result of the aforementioned energy recuperation is at least partly neutralised.

This can be done for example by controlling the relative speeds such that the compression stages that are most negatively affected by the impact of the aforementioned energy recuperation, take up a smaller proportion of the total load, while the compression stages that are less negatively affected by the aforementioned impact, take up a greater share of the total load.

For a turbo type compressor, the efficiency is determined among others by the occurrence of the phenomenon of "surging" or pumping, such that there can be a reversal of the gas flow through the compressor element, when the compressor element goes into conditions outside its operating region of temperature, pressure and speed. Similarly, for each compressor element of the screw type there is a certain operating region of temperature, pressure and speed, outside which the compressor element cannot be used.

The invention thus offers the possibility to use the compressor element within this optimum operating region by responding to the cooling sequence, coupled to the speed control.

In this way the compressor can operate closer to the limits of its operating region without having to take account of an important safety region in the vicinity of this limit.

Preferably, in a method according to the invention, the relative speeds of the compression stages are changed in proportion to the changes of their respective inlet temperatures.

Also preferably, heat exchangers of the tube type are used with tubes that are placed in a housing with an input and output for a first medium that flows through the tubes and an input and output for a second medium that flows around the tubes, and whereby in this case, but not strictly necessary, the coolant flows through the tubes and the gas along the tubes.

By guiding the gas along the tubes of the heat exchanger, the pressure drop of the gas while flowing through the heat exchanger is limited. This of course has a favourable effect on the compressor efficiency.

DESCRIPTION OF THE DRAWINGS

With the intention of better showing the characteristics of the invention, a preferred method according to the invention is described hereinafter by way of an example, without any limiting nature, with reference to the accompanying drawings, wherein:

FIG. 1 shows a compressor 1 for compressing a gas, for example air, with two compression stages connected in series in this case. Each compression stage is realised by a compressor element of the turbo type, a low-pressure compressor element 2 and a high-pressure compressor element 3 respectively.

DETAILED DESCRIPTION OF PREFERRED EMBODIMENTS OF THE INVENTION

Figure 1:
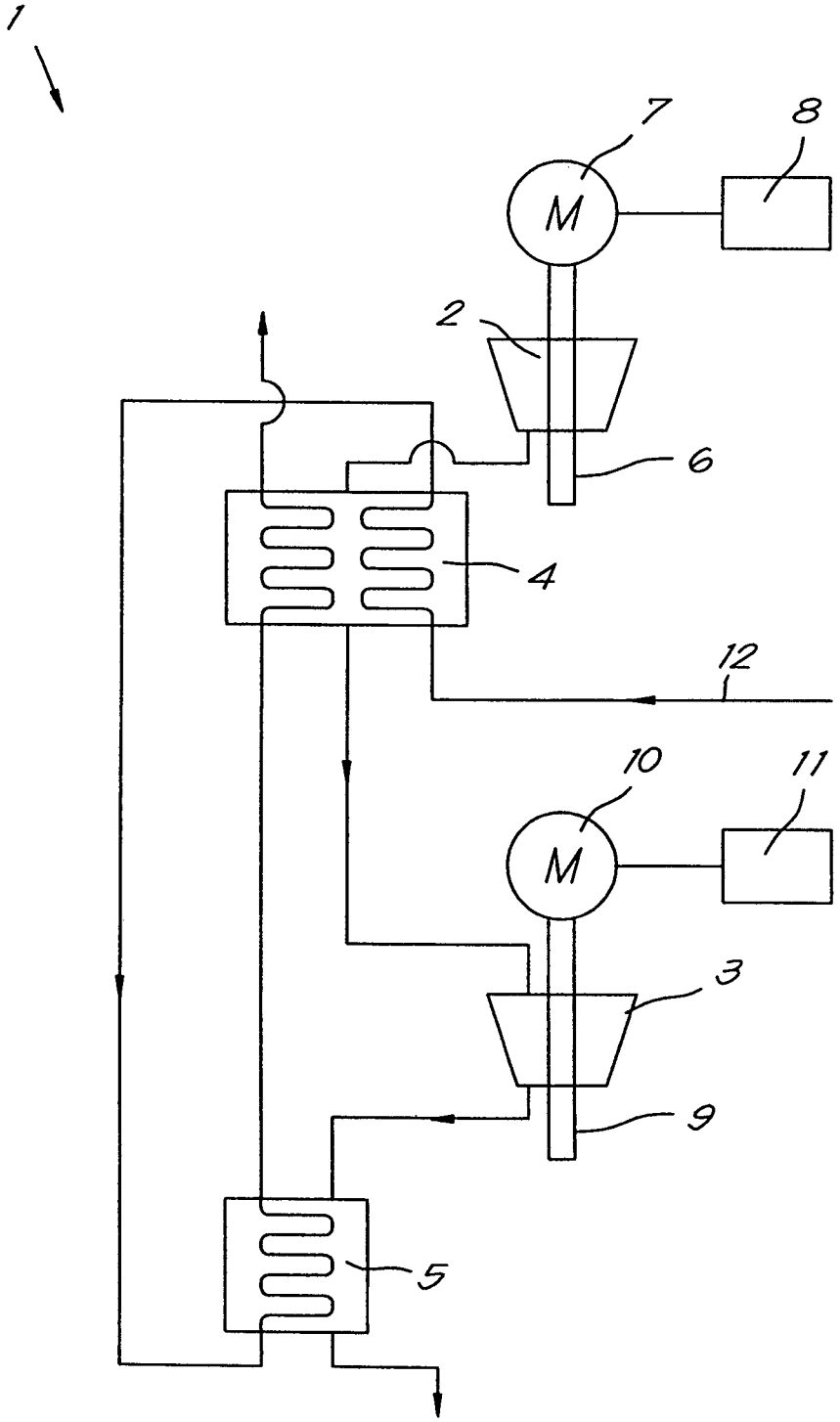
FIG. 1 schematically shows a device for the application of a method according to the invention for recovering energy.

In this specific example, the outlet temperature of the first low-pressure compressor element 2 is higher than the outlet temperature of the second high-pressure compressor element 3.

In this case there is a heat exchanger downstream from each compressor element 2 and 3, more particularly a first heat exchanger 4 or intercooler downstream from the low-pressure compressor element 2, and a second heat exchanger 5 or after-cooler downstream from the high-pressure compressor element 3.

The low-pressure compressor element 2 is connected to a first shaft 6 that is driven by a first motor 7 with a motor control 8.

The high-pressure compressor element 3 is connected to a second shaft 9 that is driven by a second motor 10, also equipped with a motor control 11. It goes without saying that the invention is not limited to the application of two motor controls 8 and 11, but the motors 7 and 10 can also be driven by means of a single motor control or by more than two motor controls.

Each heat exchanger 4 and 5 contains a primary part through which the gas from a compression stage upstream from the heat exchanger is guided, and a secondary part through which the coolant is guided. In this case the intercooler 4 is also equipped with a tertiary part. This enables the coolant to be sent through the intercooler 4 up to two times. Such a tertiary part can also be provided in a different heat exchanger in a device for the application of a method according to the invention.

A pipe 12 supplies a coolant and guides the coolant in a certain sequence through the different heat exchangers 4 and 5. In this case the coolant consists of water, but it can be replaced by another coolant such as a liquid or gas, without going beyond the scope of the invention.

According to a characteristic not shown in the drawings, downstream from one or more heat exchangers 4 and/or 5, water separators can be provided that allow condensate to be removed that can occur in the primary side of the heat exchangers.

The method according to the invention is very simple and as follows.

A gas, in this case air, is drawn in through the inlet of the low-pressure compressor element 2, to then be compressed in this compressor element 2 up to a certain pressure.

Before sending the air through a second compression stage downstream from the low-pressure stage, the air is guided through the primary part of the first heat exchanger 4 in the form of an intercooler, whereby the aforementioned air is cooled. After all, it is important to cool the air between successive stages, as this fosters the efficiency of the compressor 1.

After the air has flowed through the aforementioned first heat exchanger 4, the air is then guided through the high-pressure compressor element 3 and the after-cooler 5.

After the air has left the compressor 1, the compressed air is used in an application located downstream, for example to drive equipment or similar, or it can first be guided to post-treatment equipment such as a filtering and/or drying device.

The coolant, for example water, is guided successively through the secondary part of the intercooler 4 and the after-cooler 5 to finally go through the tertiary part of the intercooler 4. The water cools the compressed air between successive stages.

In the current state-of-the-art the water is used to cool the compressed air between successive stages. The energy recuperation, in the form of hot water, is minimal as the water is insufficiently heated while flowing through the heat exchangers.

The method according to the invention is characterised by the fact that the coolant is not only used to cool the compressed gas, but that the coolant is also heated to such an extent that the aforementioned heat can be usefully deployed. In this specific example the water is preferably heated to around 90° C.

The heating of the coolant to a sufficient extent is realised according to the invention by guiding the coolant successively through the heat exchangers 4 and 5 in series. Moreover, the sequence with which the coolant flows through the different heat exchangers 4 and 5 is preferably determined such that the coolant, after it has gone through the different heat exchangers 4 and 5, is at the highest possible temperature.

As shown in FIG. 1, in this case the water first flows through the intercooler 4, and then through the after-cooler 5 and again through the intercooler 4.

In this case the temperature of the compressed gas at the input of the intercooler 4 is substantially higher than the temperature of the air at the input of the after-cooler 5, hence in the last instance the water is guided through the intercooler 4.

In other words the sequence in which the coolant is guided through the heat exchangers is preferably chosen such that the temperature at the inlet of the primary part of at least one subsequent heat exchanger is higher than or equal to the temperature at the inlet of the primary part of a preceding heat exchanger, as seen from the direction of flow of the coolant.

According to a highly preferable characteristic of the invention, the aforementioned subsequent heat exchanger is formed by the last heat exchanger through which the coolant flows. This last heat exchanger can of course also be the first heat exchanger through which the coolant flows, as is indeed the case here, but this is not strictly necessary according to the invention.

The temperature of the compressed gas at the end of a compression stage is proportional to the power that the compressor element absorbs in the compression stage concerned. The sequence in which the coolant is guided through the different heat exchangers can consequently also be formulated according to the power that is absorbed by the different compressor elements.

In a method according to the invention, in the last instance the coolant is preferably guided through the heat exchanger in which the gas from the compressor element that absorbs the highest power flows through the primary part.

In this case the compressor element of the low-pressure stage 2 is driven by a motor 7 with a higher power than the motor 10 that is used to drive the compressor element of the high-pressure stage 3, and consequently in the last instance the coolant is sent through the tertiary part of the intercooler 4.

The aforementioned energy recuperation is preferably constructed such that it has a minimal impact on the overall efficiency of the compressor by attuning the sequence in which the coolant is guided through the different heat exchangers to the impact of the sequence on the different inlet temperatures of the stages and their accompanying influence on the total system efficiency.

The coolant that is guided through the tertiary part of the first heat exchanger 4 is in this case already at a relatively high temperature compared to the temperature of the coolant initially supplied. There is thus a risk that the compressed gas is inadequately cooled between the low-pressure stage and the high-pressure stage. This would certainly have a detrimental effect on the efficiency of the compressor, as in order to obtain optimum efficiency, the inlet temperatures of the stages have to be kept as low as possible. In the worst case this could even prevent the operation of the compressor.

The aforementioned side-effect can be remedied by equipping the first heat exchanger 4 with a tertiary part. In this way the initially supplied coolant is first guided through the secondary part of the intercooler 4, such that the compressed gas can be cooled between the low-pressure stage and high-pressure stage.

Figure 2:
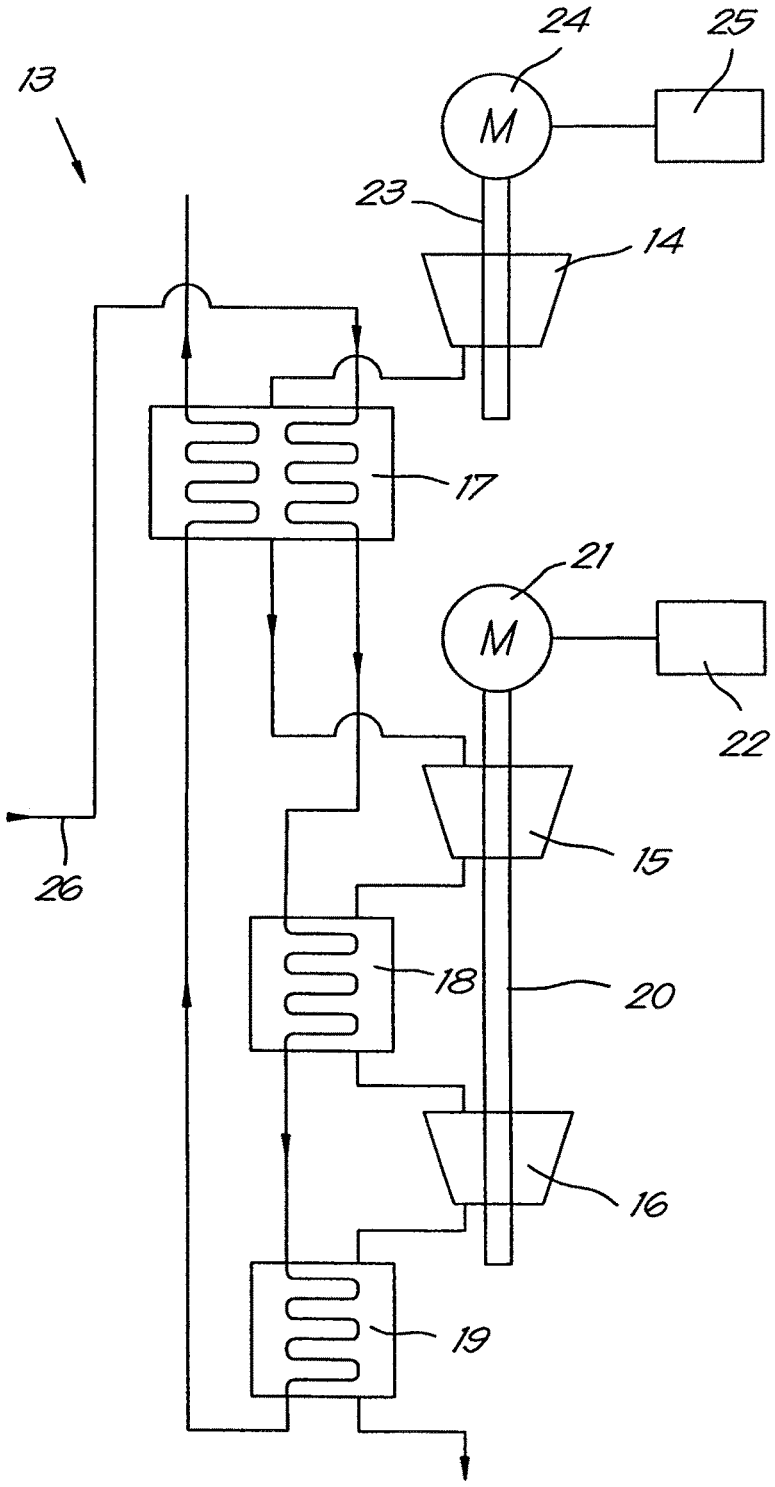
FIG. 2 shows a variant of a device for the application of a method according to the invention.
Figure 3:
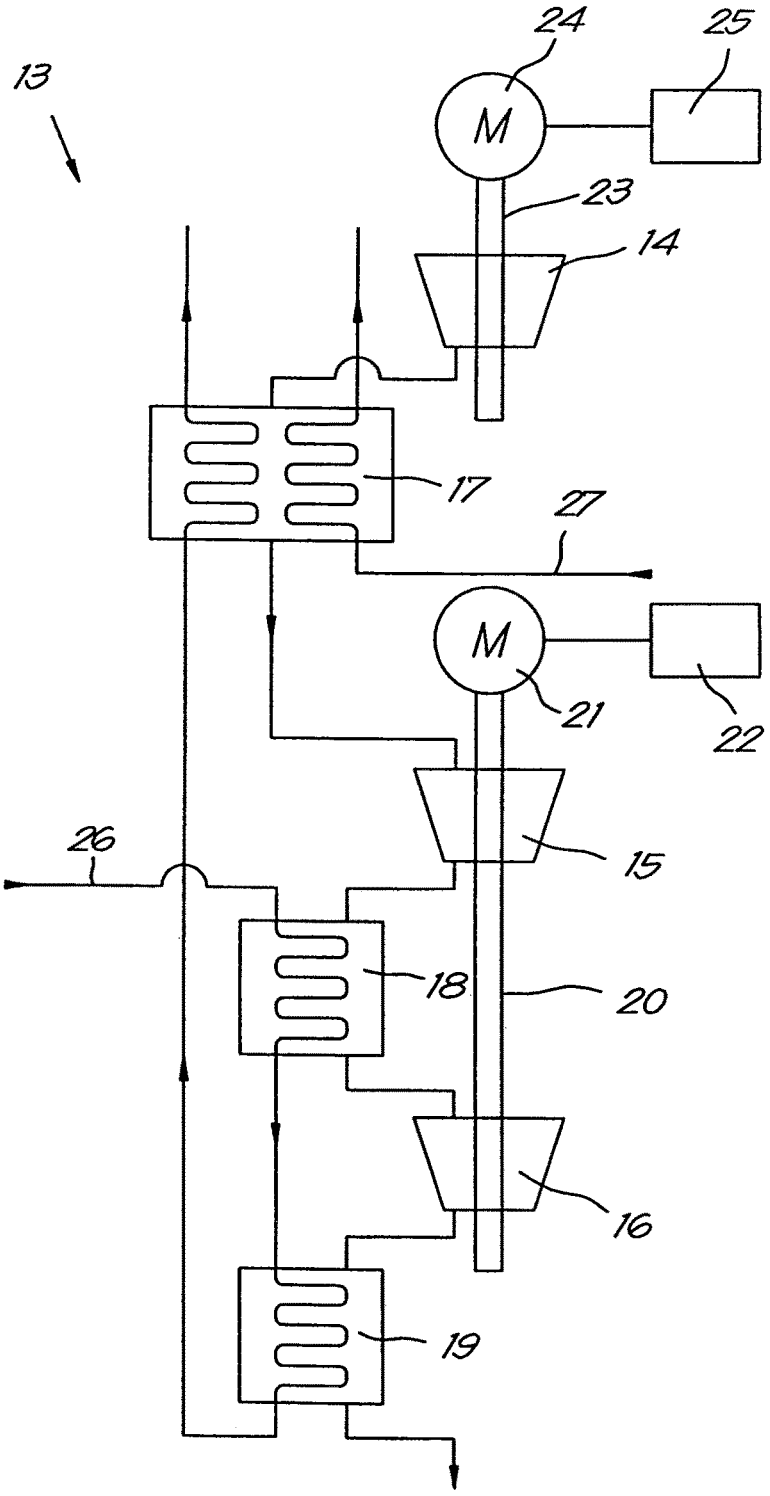
FIG. 3 shows a variant according to FIG. 2.

The foregoing is illustrated in FIGS. 2 and 3 which show a compressor 13 with three compression stages connected in series. Each compression stage is realised by a compressor element of the turbo type, respectively a low-pressure compressor element 14, a first high-pressure compressor element 15 and a second high-pressure compressor element 16.

In this case, there is a heat exchanger downstream from each compressor element, more specifically a first heat exchanger 17 or intercooler downstream from the low-pressure compressor element 14, a second heat exchanger 18 or intercooler of the first high-pressure compressor element 15 and a third heat exchanger 19 or after-cooler downstream from the second high-pressure compressor element 16.

The first and the second high-pressure compressor element 15 and 16 have the same common shaft 20 that is driven by a first motor 21 with a motor control 22. The low-pressure compressor element 14 is in turn connected to a second shaft 23 that is driven by a second motor 24, also equipped with a motor control 25.

By driving the two high-pressure compressor elements 15 and 16 by means of one shaft 20, their relative speeds are always equal.

In this case the aforementioned motors 21 and 24 deliver identical power. This implies that the low-pressure compressor element absorbs more power compared to the other two compressor elements 15, 16.

In a compressor the absorbed power of a stage is almost fully converted into the form of heat, such that the first intercooler 17 has to cool twice the power compared to the other two heat exchangers 18, 19. This also implies that the temperature of the compressed gas at the outlet of the low-pressure stage is much higher than the temperature of the compressed gas at the end of the other compression stages. The coolant, as shown in FIGS. 2 and 3, is supplied by a pipe 26. In the last instance the aforementioned coolant is sent through the first intercooler 17, and this primarily for two reasons. Firstly the temperature of the compressed gas at the primary side of the first intercooler 17 is the highest, such that the coolant can reach a maximum outlet temperature.

Secondly the cooling power of the first intercooler 17 is the highest such that, for a given coolant, an outlet temperature of 90° C., for example, keeps the impact on the performance of the other two heat exchangers 18, 19 limited.

The sequence of the coolant is preferably further determined through the fact that, between two successive heat exchangers in the sequence, the coolant first flows through the heat exchanger in which the gas from the compressor element with the lowest power uptake flows through the primary part.

The two high-pressure compressor elements 15 and 16, as shown in FIGS. 2 and 3, in this case absorb identical power. In this case the coolant first flows through the second intercooler 18 and then through the after-cooler 19.

In order to sufficiently cool the compressed gas between the low-pressure stage and the first high-pressure stage, as shown in FIG. 2, the coolant initially supplied is first sent through the first intercooler 17 to then flow through the second intercooler 18, the after-cooler 19, and the first intercooler 17.

A variant of the embodiment described above is given in FIG. 3, where a second coolant is supplied via a pipe 27. The aforementioned coolant is used to sufficiently cool the compressed gas between the low and first high-pressure stage by sending it through the secondary part of the first intercooler 17.

The water, and more generally the coolant, can also be used to cool one or more of the motors 7, 10, 21 and/or 24 with their respective motor control 8, 11, 22 and/or 25. Preferably the coolant is first used to cool the motors before sending the coolant through the different heat exchangers.

Preferably heat exchangers of the tube type are used in which the compressed air flows along the different tubes of heat exchanger. In this way the pressure drop of the air across a heat exchanger is kept limited.

The compressor elements 15 and 16 of the second and third stage are driven by a common drive, in this case in the form of a shaft 20 of a motor 21 whose speed can be controlled independently of the drive of the compressor element 14 of the first stage.

The present invention is by no means limited to the method described as an example and shown in the drawings, but such a method can be realised in all kinds of ways, without departing from the scope of the invention.

The invention claimed is:

1. A method for recovering energy when compressing a gas using a compressor having two or more compression stages, with each stage including a compressor element, wherein downstream from each of at least two of said compressor elements there is a heat exchanger, comprising the steps:

guiding compressed gas from a first compression stage upstream from a first heat exchanger through a primary part of the first heat exchanger and guiding the compressed gas from the primary part of the first heat exchanger to a second compression stage and through a primary part of a second heat exchanger;

guiding a coolant to recover part of the compression heat from the compressed gas successively in series through a secondary part of the first heat exchanger and through a secondary part of the second heat exchanger;

selecting the sequence in which the coolant is guided in series through the first heat exchanger and the second heat exchanger so that the temperature at an inlet of the primary part of the first heat exchanger is higher than or equal to the temperature at an inlet of the primary part of the second heat exchanger; and providing at least one of the first heat exchanger and the second heat exchanger with a tertiary part for the coolant or another coolant.

2. The method according to claim 1, wherein the second heat exchanger is the last heat exchanger through which the coolant is guided.

3. The method according to claim 1, wherein the steps are carried out such that there is a minimal impact on the overall efficiency of the compressor by attuning the sequence with which the coolant is guided through the different heat exchangers to the impact of the sequence on the different inlet temperatures of the stages and their accompanying effect on total system efficiency.

4. The method according to claim 1, wherein the sequence in which the coolant is guided through the first heat exchanger and the second heat exchanger is selected such that, between two successive heat exchangers in the sequence of the first and the second heat exchangers, the coolant first flows through one of the heat exchangers in which the gas flows through the primary part of the compressor element with a lowest cooling power uptake.

5. The method according to claim 1, wherein the coolant is guided sequentially through all heat exchangers of the compressor.

6. The method according to claim 1, wherein, the coolant first flows through the secondary part of the heat exchanger with the tertiary part, then through the other heat exchangers, and finally through the tertiary part of the heat exchanger with the tertiary part.

7. The method according to claim 1, wherein when the gas is compressed in three stages, the compressor further comprises a third compression stage and a third heat exchanger, wherein the compressor has a low-pressure stage, a first high-pressure stage and a second high-pressure stage, wherein the low-pressure stage comprises the first heat exchanger, the first high-pressure stage comprises the second heat exchanger, and the second high-pressure stage comprises the third heat exchanger, so that the coolant is guided successively through the first, second, third heat exchangers and finally back through the first heat exchanger.

8. The method according to claim 1, wherein before flowing through the different heat exchangers, the coolant is used to cool one or more motors driving the compressor elements and/or their respective motor controls.

9. The method according to claim 1, wherein a second coolant flows through the tertiary part.

10. The method according to claim 9, wherein the second coolant is also used to cool one or more motors driving the compressor elements and/or their respective motor controls.

11. The method according to claim 1, further comprising the step of controlling a rotational speed of one or more compressor elements.

12. The method according to claim 11, wherein rotational speeds of the compression stages are controlled in order to at least partly change at least a pressure or temperature of each compressor stage-operating region.

13. The method according to claim 11, wherein the relative rotational speeds of the compression stages are changed in proportion to a change of a respective inlet temperature of the compression stage.

14. The method according to claim 1, wherein tube type heat exchangers are used, said heat exchangers comprising tubes in a housing with an input and output for a first medium that is caused to flow through the tubes and an input and an output for a second medium that is caused to flow around the tubes, and wherein the coolant is caused to flow through the tubes and the gas is caused to flow around the tubes.

15. The method according to claim 1, further comprising a third heat exchanger.

16. A method for recovering energy when compressing a gas using a compressor having two or more compression stages, with each stage including a compressor element, wherein downstream from each of at least two of said compressor elements there is a heat exchanger, comprising the steps:

guiding compressed gas from a first compression stage upstream from a first heat exchanger through a primary part of the first heat exchanger and guiding the compressed gas from the primary part of the first heat exchanger to a second compression stage and through a primary part of a second heat exchanger and guiding the compressed gas from the primary part of the second heat exchanger to a third compression stage and through a primary part of a third heat exchanger;

guiding a coolant to recover part of the compression heat from the compressed gas successively in series through a secondary part of the first heat exchanger and through a secondary part of the second heat exchanger;

selecting the sequence in which the coolant is guided in series through the first heat exchanger and the second heat exchanger so that the temperature at an inlet of the primary part of the first heat exchanger is higher than or equal to the temperature at an inlet of the primary part of the second heat exchanger; and providing at least one of the first heat exchanger and the second heat exchanger with a tertiary part for the coolant or another coolant, wherein the compressor has a low-pressure stage, a first high-pressure stage and a second high-pressure stage, where the low-pressure stage comprises the first heat exchanger, the first high-pressure stage comprises the second heat exchanger, and the second high-pressure stage comprises the third heat exchanger, so that the coolant first flows through the second heat exchanger, then through the third heat exchanger and finally through the first heat exchanger.

17. The method according to claim 16, wherein the compressor elements of the first and second high-pressure stages are driven by a common drive whose rotational speed is controlled independently from a drive for the compressor element of the low-pressure stage.

18. The method according to claim 16, wherein the first heat exchanger comprises the heat exchanger with the tertiary part.

19. A method for recovering energy when compressing a gas using a compressor having at least three compression stages, with each stage including a compressor element, wherein downstream from each compressor element there is a heat exchanger, comprising the steps:

guiding compressed gas from a low-pressure stage upstream from a first heat exchanger through a primary part of the first heat exchanger and guiding a coolant to recover part of the compression heat from the compressed gas, through a secondary part of the first heat exchanger, wherein the first heat exchanger has a tertiary part for the coolant or another coolant;

guiding the coolant successively in series through a secondary part of at least a second heat exchanger and a secondary part of a third heat exchanger of at least a first high-pressure stage and a second high-pressure stage, respectively;

selecting the sequence in which the coolant is guided through the at least first, second, and third heat exchangers so that the temperature at an inlet of the primary part of the first heat exchanger is higher than or equal to the temperature at an inlet of the primary part of a preceding heat exchanger, relative to the direction of flow of the coolant; and guiding the coolant successively through the secondary part of the first heat exchanger, the secondary part of the second heat exchanger, the secondary part of the third heat exchanger and finally back through the tertiary part of the first heat exchanger.

20. A method for recovering energy when compressing a gas using a compressor having two or more compression stages, each compression stage including a compressor element, wherein downstream from each of the compressor elements there is a heat exchanger, comprising the steps:

compressing gas in at least a first stage;

guiding compressed gas from the first stage upstream from a first heat exchanger through a first part of the first heat exchanger and guiding a coolant to recover part of the compression heat from the compressed gas through a second part of the first heat exchanger, wherein the first heat exchanger also includes a tertiary part for the coolant or another coolant;

guiding the compressed gas from the first stage in series to at least a second stage and guiding the compressed gas from the second stage upstream from a second heat exchanger through a first part of the second heat exchanger;

guiding the coolant successively in series from the second part of the first heat exchanger through a second part of the second heat exchanger; and guiding the coolant successively from the second part of the second heat exchanger through the tertiary part of the first heat exchanger, wherein a sequence in which the coolant is guided through the first and second heat exchanger is provided in a way such that the temperature at an inlet of the first part of the first heat exchanger is higher than or equal to the temperature at an inlet of the first part of the second heat exchanger.

21. The method according to claim 20, further comprising a third heat exchanger.

* * * * *